US012338820B2

(12) United States Patent
Uetsuji et al.

(10) Patent No.: US 12,338,820 B2
(45) Date of Patent: Jun. 24, 2025

(54) UNIAXIAL ECCENTRIC SCREW PUMP

(71) Applicant: HEISHIN Ltd., Hyogo (JP)

(72) Inventors: Eiji Uetsuji, Shiga (JP); Noriaki Sakakihara, Osaka (JP)

(73) Assignee: HEISHIN Ltd., Hyogo (JP)

( * ) Notice: Subject to any disclaimer, the term of this patent is extended or adjusted under 35 U.S.C. 154(b) by 0 days.

(21) Appl. No.: 18/727,077

(22) PCT Filed: Sep. 28, 2022

(86) PCT No.: PCT/JP2022/036254
§ 371 (c)(1),
(2) Date: Jul. 6, 2024

(87) PCT Pub. No.: WO2023/139848
PCT Pub. Date: Jul. 27, 2023

(65) Prior Publication Data

US 2025/0154951 A1 May 15, 2025

(30) Foreign Application Priority Data

Jan. 18, 2022 (JP) ..... 2022-005929
Aug. 3, 2022 (JP) ..... 2022-124265

(51) Int. Cl.
*F04C 2/107* (2006.01)

(52) U.S. Cl.
CPC ..... *F04C 2/107* (2013.01)

(58) Field of Classification Search
CPC ..... F04C 2/107
(Continued)

(56) References Cited

U.S. PATENT DOCUMENTS 4,104,009 A * 8/1978 Chanton ..... F04C 2/1073 418/48
4,773,834 A * 9/1988 Saruwatari ..... F04C 2/1071 418/153

(Continued)

FOREIGN PATENT DOCUMENTS

DE 102013109829 A1 * 3/2015 ..... F04C 2/1073
JP 2005-344587 A 12/2005
JP 2016-079971 A 5/2016

OTHER PUBLICATIONS

Translation: DE 102013109829 Tekneyan Mikael, 2015 (Year: 2015).*
International Search Report for corresponding Application No. PCT/JP2022/036254, mailed Nov. 29, 2022.

*Primary Examiner* — Jesse S Bogue
(74) *Attorney, Agent, or Firm* — Renner, Otto, Boisselle & Sklar, LLP

(57) ABSTRACT

A uniaxial eccentric screw pump includes: a stator having an insertion hole with an inner peripheral surface being internally threaded; and a rotor being externally threaded and placed through the insertion hole. In a cross section, the rotor has a cross-sectional center displaceable in a reciprocating manner in a longitudinal direction of the insertion hole between a pair of turn positions along a center line extending in the longitudinal direction during eccentric rotation of the rotor. The rotor comes in contact with the inner peripheral surface of the insertion hole in a lateral direction of the insertion hole. An interference amount between the rotor and the stator includes a first interference amount when the cross-sectional center is at one of the turn positions and a second interference amount when the cross-sectional center is at a central axis. The first interference amount is larger than the second interference amount.

14 Claims, 14 Drawing Sheets

(58) Field of Classification Search
USPC ..... 418/48
See application file for complete search history.

(56) References Cited

U.S. PATENT DOCUMENTS

| | | | | | |
|---|---|---|---|---|---|
| 4,863,359 | A * | 9/1989 | Unterstrasser | ..... | F04C 2/1075 418/153 |
| 8,556,603 | B2 * | 10/2013 | Ree | ..... | F04C 13/008 418/48 |
| 11,499,549 | B2 * | 11/2022 | Barbour | ..... | F04C 13/008 |
| 2014/0308145 | A1 * | 10/2014 | Twidale | ..... | F04C 13/008 418/48 |

* cited by examiner

UNIAXIAL ECCENTRIC SCREW PUMP

CROSS-REFERENCE TO RELATED APPLICATIONS

This is a national phase application in the United States of International Patent Application No. PCT/JP2022/036254 with an international filing date of Sep. 28, 2022, which claims priority of Japanese Patent Application No. 2022-005929 filed on Jan. 18, 2022 and Japanese Patent Application No. 2022-124265 filed on Aug. 3, 2022, the contents of which are incorporated herein by reference.

TECHNICAL FIELD

The present invention relates to a uniaxial eccentric screw pump.

BACKGROUND ART

As disclosed in, for example, JP-A-2005-344587, a known uniaxial eccentric screw pump includes a stator having an insertion hole with its inner peripheral surface internally threaded and a rotor including an externally threaded shaft placed through the insertion hole in the stator.

In the known uniaxial eccentric screw pump, the rotor and the stator have, between them, substantially the same interference value when the rotor is located in two end areas in an opening that is the cross section of the insertion hole in the stator and when the rotor is located in a middle area in the opening.

SUMMARY OF THE INVENTION

Problems to be Solved by the Invention

When the interference amount is sufficiently large, the rotor uses higher torque and a greater driving force to rotate.

However, the interference amount decreased to facilitate movement of the rotor can lower the sealing tightness, causing inappropriate delivery of a fluid.

One or more aspects of the present invention are directed to a uniaxial eccentric screw pump that achieves tight sealing and also reduces the driving force for rotating a rotor.

Solutions to the Problems

The inventors have noticed that the interference amount can be relatively small in the middle area when the interference amount is sufficient in the two end areas, and have developed a uniaxial eccentric screw pump according to one or more aspects of the present invention.

A uniaxial eccentric screw pump according to an aspect of the present invention includes a stator having an insertion hole with an inner peripheral surface being internally threaded, and a rotor including a shaft being externally threaded and placed through the insertion hole in the stator. The rotor performs eccentric rotation about a central axis of the stator. In a cross section perpendicular to the central axis, the insertion hole is an elongated hole. The rotor has a cross-sectional center displaceable in a reciprocating manner in a longitudinal direction of the insertion hole between a pair of turn positions along a center line extending in the longitudinal direction through the central axis of the stator during the eccentric rotation of the rotor. The pair of turn positions are opposite to each other in the longitudinal direction with respect to the central axis. The rotor comes in contact with the inner peripheral surface of the insertion hole in a lateral direction of the insertion hole perpendicular to the longitudinal direction. An interference amount between the rotor and the stator includes a first interference amount when the cross-sectional center is at one of the pair of turn positions and a second interference amount when the cross-sectional center is at the central axis. The first interference amount is larger than the second interference amount.

In this structure, the interference amount between the rotor and the stator is the first interference amount when the rotor is located in one of the two end areas of the insertion hole, or in other words, when the rotor has the cross-sectional center at one of the turn positions that are the limits of the reciprocation range in the insertion hole in the cross section perpendicular to the central axis of the stator. The interference amount between the rotor and the stator is the second interference amount when the rotor is located in the middle area of the insertion hole, or in other words, when the rotor has the cross-sectional center located at the central axis that is the center of the reciprocation range in the insertion hole. The first interference amount is larger than the second interference amount. In the two end areas of the insertion hole, the rotor is thus in tighter contact with the inner peripheral surface of the insertion hole and can maintain the sealing tightness. In the middle area with the smaller interference amount, the rotor uses a less driving force to rotate.

The interference amount between the rotor and the stator may decrease gradually from the first interference amount to the second interference amount with the cross-sectional center being displaced from one of the pair of turn positions toward the central axis along the center line.

When the cross-sectional center is at a point on the center line, the interference amount between the rotor and the stator may be an excess of a distance between the cross-sectional center at the point and an outer peripheral surface of the rotor in the lateral direction over a distance between the point and the inner peripheral surface of the insertion hole in the lateral direction in a natural state of the stator with no contact with the rotor.

The insertion hole may have a first hole width being a dimension of the insertion hole in the lateral direction at each of the pair of turn positions in a natural state with no contact with the rotor, and may have a second hole width being a dimension of the insertion hole in the lateral direction at the central axis in the natural state. The rotor may have a first rotor width being a dimension of the rotor in the lateral direction at the cross-sectional center at each of the pair of turn positions, and may have a second rotor width being a dimension of the rotor in the lateral direction at the cross-sectional center at the central axis. A difference of the first rotor width from the second rotor width may be greater than a difference of the first hole width from the second hole width.

The first hole width may be less than the second hole width. The first hole width may be equal to the second hole width. The first hole width may be greater than the second hole width.

When the first hole width is equal to the second hole width, the insertion hole may have a shape of a racetrack in the cross section.

The rotor may have a shape of a non-perfect circle having a longitudinal axis and a lateral axis perpendicular to each other in the cross section. When the cross-sectional center is at one of the pair of turn positions, the longitudinal axis may be parallel to the lateral direction and the lateral axis may be parallel to the longitudinal direction. When the cross-sectional center is at the central axis, the longitudinal axis may be parallel to the longitudinal direction and the lateral axis may be parallel to the lateral direction.

The rotor may be elliptical in the cross section. The rotor may be oval in the cross section. The rotor with this simple structure can be manufactured easily.

The rotor may include, in the cross section, first curves at two sides in a direction in which the lateral axis extends, and may include second curves at two ends in a direction in which the longitudinal axis extends. The first curves may have a greater curvature radius than the second curves. The rotor may be, in the cross section, asymmetric in a direction in which the longitudinal axis extends.

The stator may consist of a stator body formed from an elastic material. This structure includes fewer components and facilitates manufacture at low costs.

When the cross-sectional center is at one of the pair of turn positions, the rotor may have an outer peripheral surface in contact with the inner peripheral surface of the insertion hole in the longitudinal direction with a predetermined interference amount in the longitudinal direction.

Effects of the Invention

The uniaxial eccentric screw pump according to the above aspects of the present invention achieves tight sealing and also reduces the driving force for rotating the rotor.

DETAILED DESCRIPTION

Embodiments of the disclosure will now be described with reference to the accompanying drawings. The terms for specific directions or positions (e.g., terms including up, down, side, and end) are used herein as appropriate to facilitate understanding of the present invention with reference to the drawings. However, such terms do not limit the technical scope of the present invention. The drawings are schematic and are not drawn to scale relative to the actual size of each component.

Figure 1:
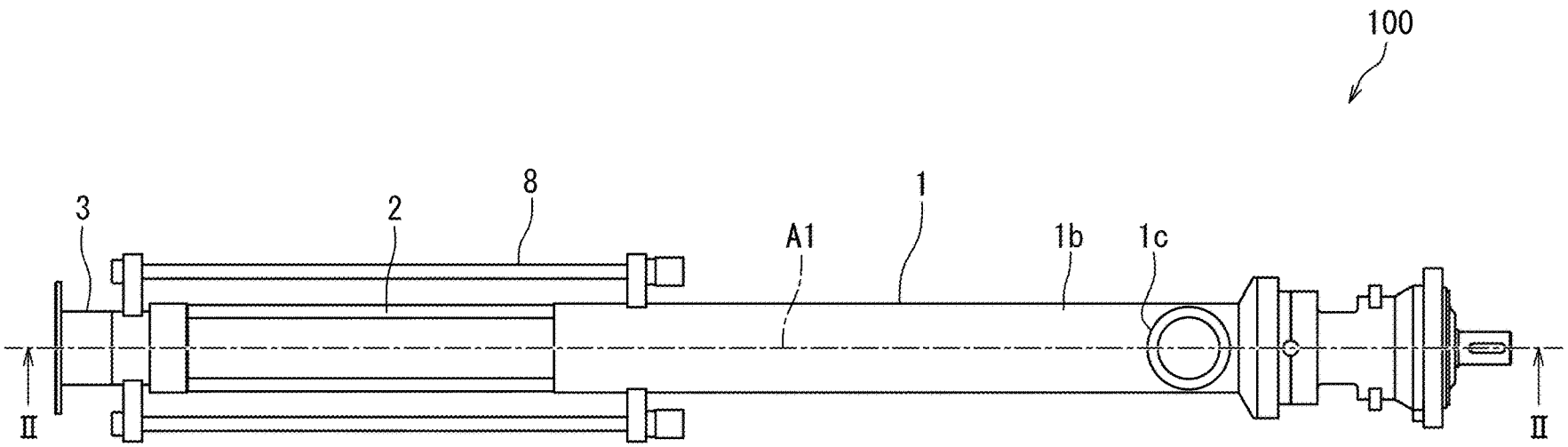
FIG. 1 is a schematic front view of a uniaxial eccentric screw pump according to a first embodiment of the present invention.
Figure 2:
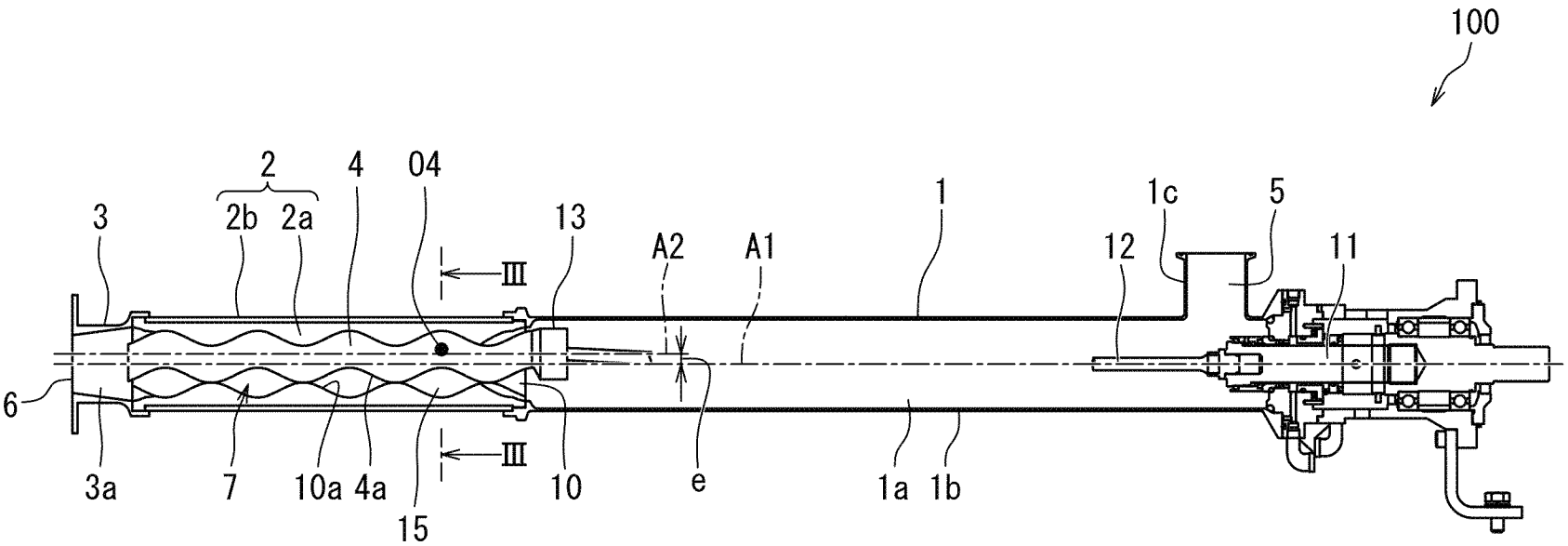
FIG. 2 is a longitudinal sectional view of the uniaxial eccentric screw pump taken along line II-II in FIG. 1.

FIGS. 1 and 2 show a uniaxial eccentric screw pump 100 according to a first embodiment. The uniaxial eccentric screw pump 100 is an example of a rotary positive-displacement pump and includes a casing 1, a stator 2, an end stud 3, and a rotor 4.

The casing 1, the stator 2, and the end stud 3 are tubular and coaxial. These components 1 to 3 have a central axis A1 as a common axis. The direction in which the central axis A1 extends is referred to as the axial direction. In FIGS. 1 and 2, the right end is referred to as a first end or a basal end in the axial direction, and the left end is referred to as a second end or a distal end in the axial direction.

The casing 1 is formed from a metal material. The casing 1 includes a peripheral wall 1*b* defining an internal space 1*a* extending in the axial direction, and includes a connection tube 1*c* protruding radially from the peripheral wall 1*b*. The connection tube 1*c* has a basal end in the radial direction connecting with the internal space 1*a* through a first opening 5. The internal space 1*a* is open at least at the second end of the two ends. The stator 2 has an insertion hole 10 extending in the axial direction and open at the two ends. In the present embodiment, the stator 2 includes a stator body 2*a* defining the insertion hole 10 and an outer cylinder 2*b* fitted onto the stator body 2*a*. The outer cylinder 2*b* may be bonded to the stator body 2*a* with any method. The end stud 3 includes an internal space 3*a* extending in the axial direction and open at the two ends. The end stud 3 defines a second opening 6 at the second end.

The casing 1 and the end stud 3 are connected to each other with stay bolts 8. The stay bolts 8 are turned and tightened to hold the stator 2 between the casing 1 and the end stud 3 in the axial direction. The insertion hole 10 connects with the internal space 1*a* in the casing 1 and also with the internal space 3*a* in the end stud 3. The uniaxial eccentric screw pump 100 includes a flow path 7 extending from the connection tube 1*c* through the first opening 5, the internal space 1*a* in the casing 1, the insertion hole 10 in the stator 2, and the internal space 3*a* in the end stud 3 to the second opening 6. The connection tube 1*c* is connected to a tank (not shown) storing a fluid. Examples of the fluid include a viscous material such as mayonnaise. The fluid in the tank is transferred through the flow path 7 as the rotor 4 rotates.

The rotor 4 is a shaft and is received in the insertion hole 10. The insertion hole 10 has an inner peripheral surface 10*a* including a single or multiple internally threaded portions with an n-start thread (a two-start thread in this example). The rotor 4 has an outer peripheral surface 4*a* including a single or multiple externally threaded portions with an (n−1)-start thread (a single-start thread in this example). The rotor 4 is driven by a drive (not shown) located at the first end of the casing 1 to rotate eccentrically about the central axis A1.

The uniaxial eccentric screw pump 100 includes a system for transmitting a driving force from the drive to the rotor 4 for rotation. The system includes a coupling 11 connected to the output shaft of the drive, a coupling rod 12 extending from the coupling 11, and a joint head 13 connected to the coupling rod 12. These components are accommodated in the internal space 1*a* of the casing 1. The joint head 13 is tubular and has a surface at the first end connected to the distal end of the coupling rod 12. The joint head 13 has a surface at the second end, from which the rotor 4 extends in the axial direction toward the second end through the insertion hole 10 in the stator 2.

The joint head 13 has a central axis A2 parallel to the central axis A1 of the stator 2 and is offset from the central axis A1 by an eccentricity e in the direction perpendicular to the axial direction. The coupling rod 12 is inclined with respect to the central axes A1 and A2 in the casing 1.

Figure 3:
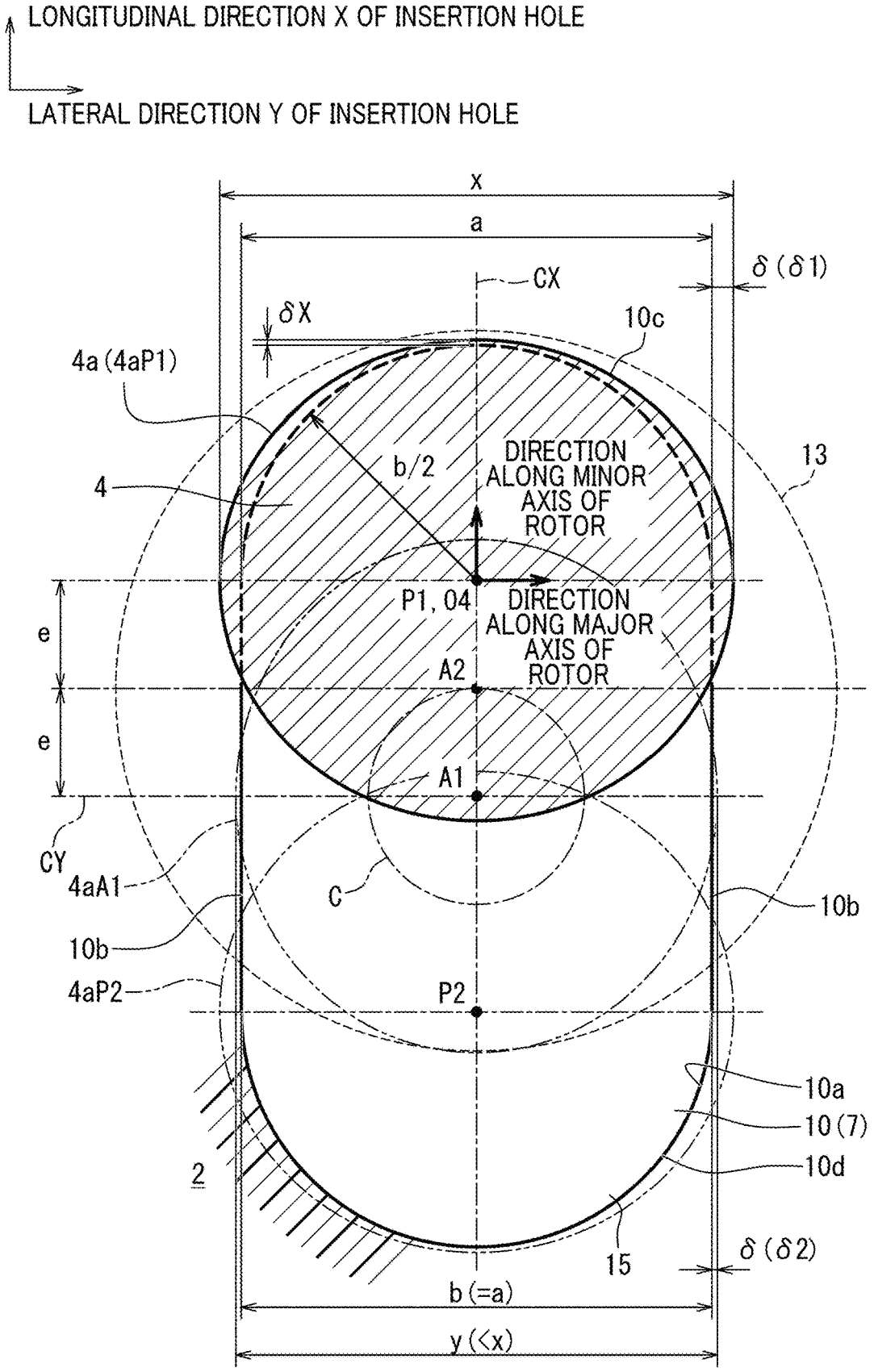
FIG. 3 is a cross-sectional view of the uniaxial eccentric screw pump taken along line III-III in FIG. 2.

FIG. 3 shows a section perpendicular to the central axes A1 and A2 (hereafter, a cross section) in which the joint head 13 is projected in the axial direction. Referring to FIG. 3, the joint head 13 rotates about the central axis A2 of the joint head 13 and revolves about the central axis A1 of the stator 2 with the drive in operation. During the revolution, the joint head 13 has the central axis A2 displaced along a circle C with the center being the central axis A1 of the stator 2 and with the radius being the eccentricity e. The rotor 4 thus performs eccentric rotation including rotation about the central axis A2 of the joint head 13 and revolution about the central axis A1 of the stator 2.

The insertion hole 10 is an elongated hole in the cross section. The insertion hole 10 is longer in a longitudinal direction X in the cross section and is shorter in a lateral direction Y perpendicular to the longitudinal direction X in the cross section. In the present embodiment, the insertion hole 10 has point symmetry (180-degree rotational symmetry) about the central axis A1. The insertion hole 10 has line symmetry about a center line CX extending in the longitudinal direction X through the central axis A1, and has line symmetry about a center line CY extending in the lateral direction Y through the central axis A1.

In the cross section, the outer peripheral surface 4*a* of the rotor 4 is a closed loop-shaped curve, which defines the shape of the rotor 4 in the cross section. The center of the rotor 4 in the cross section is hereafter referred to as a cross-sectional center O4. The cross-sectional center O4 is offset from the central axis A2 (the center of rotation of the rotor 4) of the joint head 13 by the eccentricity e in the direction perpendicular to the axial direction. As the rotor 4 rotates eccentrically, the cross-sectional center O4 is displaced in a reciprocating manner in the longitudinal direction X between a pair of turn positions P1 and P2 along the center line CX. The pair of turn positions P1 and P2 are opposite to each other in the longitudinal direction X with respect to the central axis A1. Each of the turn positions P1 and P2 is offset from the central axis A1 by twice the eccentricity e in the longitudinal direction X.

In FIG. 3, the solid line indicates the outer peripheral surface 4*a*P1 of the rotor 4 with the cross-sectional center O4 at the first turn position P1 (also refer to the hatched area). The two-dot-dash lines indicate the outer peripheral surface 4*a*A1 of the rotor 4 with the cross-sectional center O4 at the central axis A1 of the stator 2, and indicate the outer peripheral surface 4*a*P2 of the rotor 4 with the cross-sectional center O4 at the second turn position P2. The insertion hole 10 includes an area that is not occupied by the rotor 4 independently of the position of the cross-sectional center O4. This area extends in the axial direction and defines transfer spaces 15 (also refer to FIG. 2). The fluid is transferred in the transfer spaces 15 as the rotor 4 rotates eccentrically.

During displacement of the cross-sectional center O4 from the first turn position P1 to the central axis A1, the rotor 4 rotates 90 degrees and revolves 90 degrees. The same applies to the displacement of the cross-sectional center O4 from the central axis A1 to the second turn position P2, from the second turn position P2 to the central axis A1, and from the central axis A1 to the first turn position P1. Thus, the rotor 4 rotates once while revolving once, with one round trip of the cross-sectional center O4.

In the cross section, the outer peripheral surface 4*a* of the rotor 4 remains in contact with the inner peripheral surface 10*a* of the insertion hole 10 at least in the lateral direction Y. The rotor 4 is formed from a metal material. The stator body 2*a* is formed from an elastic material selected as appropriate for the type of fluid to be transferred. Examples of the elastic material include nitrile rubber, fluorine rubber, ethylene-propylene rubber, styrene-butadiene rubber, silicone rubber, and fluorosilicone rubber. The rotor 4 may be formed from a material other than a metal material, such as ceramic (e.g., silicon carbide) or a resin (e.g., nylon).

The inner peripheral surface 10*a* of the insertion hole 10 comes in contact with the outer peripheral surface 4*a* of the rotor 4 with its resilience after elastically deforming away from the central axis A1 in the lateral direction Y. Thus, the outer peripheral surface 4*a* of the rotor 4 has, in the cross section, a dimension in the lateral direction Y exceeding the dimension of the insertion hole 10 in the lateral direction Y in a natural state with no contact with the rotor 4. The amount by which the dimension exceeds is an interference amount δ between the stator 2 and the rotor 4 (in the lateral direction Y). The interference amount δ may also be referred to as the amount of elastic deformation of the inner peripheral surface 10*a* in the lateral direction Y in the contact state. A larger interference amount & achieves tighter sealing of the transfer spaces 15, but increases the driving force for eccentrically rotating the rotor 4 in the contact state.

For ease of explanation of the interference amount δ, the dimensions defined below are used. A first hole width a refers to the dimension of the insertion hole 10 in the lateral direction Y at the first turn position P1 or the second turn position P2 in the natural state. More specifically, an imaginary straight line extending in the lateral direction Y through the position P1 or P2 has two points of intersection with the inner peripheral surface 10*a* in the cross section. The direct distance between the two points is the first hole width a of the insertion hole 10 in the natural state. A second hole width b refers to the dimension of the insertion hole 10 in the lateral direction Y at the central axis A1 in the natural state.

A rotor width refers to the dimension of the rotor 4 in the lateral direction Y at the cross-sectional center O4 in the cross section. More specifically, an imaginary straight line extending in the lateral direction Y through the cross-sectional center O4 has two points of intersection with the outer peripheral surface 4*a* in the cross section. The direct distance between the two points is the rotor width. For a rotor 4 with the shape of a non-perfect circle in the cross section, the rotor width varies with the position of the cross-sectional center O4 that is displaced in a reciprocating manner as the rotor 4 rotates. A first rotor width x refers to the rotor width with the cross-sectional center O4 at the first turn position P1 or the second turn position P2. A second rotor width y refers to the rotor width with the cross-sectional center O4 at the central axis A1. The first rotor width x exceeds the first hole width a. The second rotor width y exceeds the second hole width b ($x>a$, $y>b$).

When the cross-sectional center O4 is at a point on the center line CX, the interference amount δ (in the lateral direction Y) is defined as an excess (positive value) of the distance between the cross-sectional center O4 at the point and the outer peripheral surface 4*a* of the rotor 4 in the lateral direction Y over the distance between the point and the inner peripheral surface 10*a* of the insertion hole 10 in the lateral direction Y in the natural state. In this case, a first interference amount δ1 refers to the interference amount δ for when the point is at the first turn position P1 or the second turn position P2. A second interference amount δ2 refers to the interference amount δ for when the point is at the central axis A1. The first interference amount δ1 corresponds to half the excess of the first rotor width x over the first hole width a (δ1=(x−a)/2>0). The second interference amount δ2 corresponds to half the excess of the second rotor width y over the second hole width b (δ2=(y−b)/2>0).

The first interference amount δ1 is larger than the second interference amount δ2 (δ1>δ2). In other words, the difference of the first rotor width x from the second rotor width y is greater than the difference of the first hole width a from the second hole width b (x−y>a−b). The difference herein may be a positive value, zero, or a negative value. The formula x−y>a−b can be changed into δ1>δ2 using the formula δ1=(x−a)/2 and the formula δ2=(y−b)/2.

To satisfy the relationship δ1>δ2, the insertion hole 10 in the present embodiment has the shape of a racetrack (oval) in the cross section, and the rotor 4 has the shape of a non-perfect circle having the longitudinal axis and the lateral axis perpendicular to each other at the cross-sectional center O4 in the cross section. Unless otherwise specified, the shape of the insertion hole 10 refers to the closed loop-shaped profile of the inner peripheral surface 10*a* of the insertion hole 10 in the cross section. The shape of the rotor 4 refers to the closed loop-shaped profile of the outer peripheral surface 4*a* of the rotor 4 in the cross section.

The insertion hole 10 has the shape of a racetrack including a pair of straight portions 10*b* extending parallel to the longitudinal direction X, a first semicircular portion 10*c* connecting first ends of the straight portions 10*b*, and a second semicircular portion 10*d* connecting second ends of the straight portions 10*b*. The pair of straight portions 10*b* are spaced from each other by the second hole width b in the lateral direction Y.

In the present embodiment, the first turn position P1 corresponds to a connection position at which the first semicircular portion 10*c* is connected to each straight portion 10*b* in the longitudinal direction X. The first hole width a is thus equal to the second hole width b (a=b). The first semicircular portion 10*c* defines a half circle with the center being at the first turn position P1 and with the radius being the first hole width a (second hole width b). The same applies to the second turn position P2.

In the present embodiment, the rotor 4 has the shape of an ellipse as an example of the non-perfect circle. The ellipse is not limited to an ellipse in a geometric sense, but may also be a shape similar to such an ellipse. For example, the ellipse may include an ellipse-like polygon including multiple line segments. In this case, the line segments may be connected with smooth curves such as circular arcs. The ellipse-like shape may include any lines. For example, the shape may be a super ellipse that is a closed curve similar to an ellipse and satisfies the formula below.

$$\left|\frac{x}{a}\right|^n + \left|\frac{y}{b}\right|^n = 1$$

n, a, and b: positive numbers

||: absolute value

Figure 4:
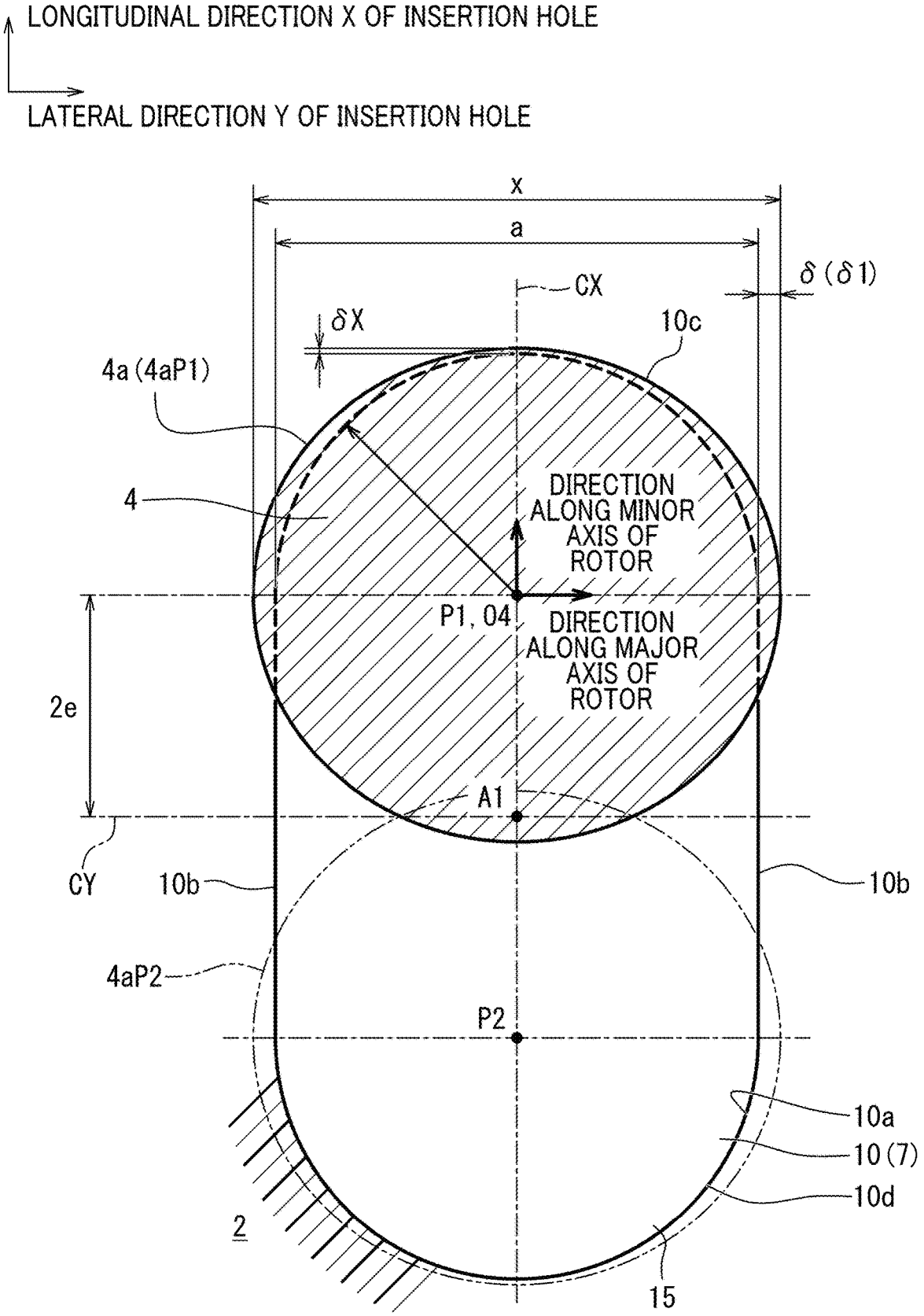
FIG. 4 is a cross-sectional view of a part of a stator and a rotor located in one of two end areas of an insertion hole.
Figure 5:
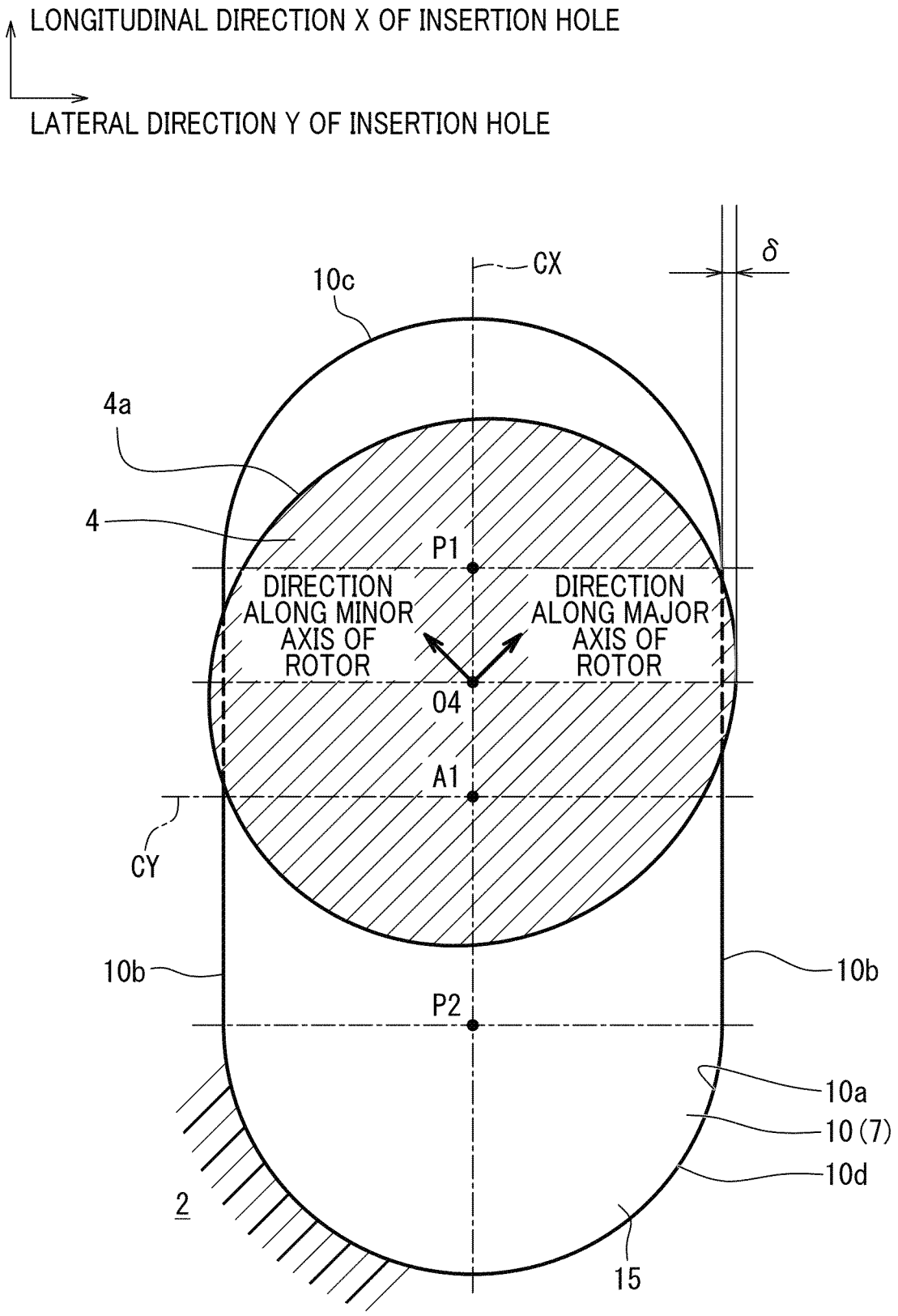
FIG. 5 is a cross-sectional view of the rotor rotating and moving from one of the two end areas toward a middle area of the insertion hole.
Figure 6:
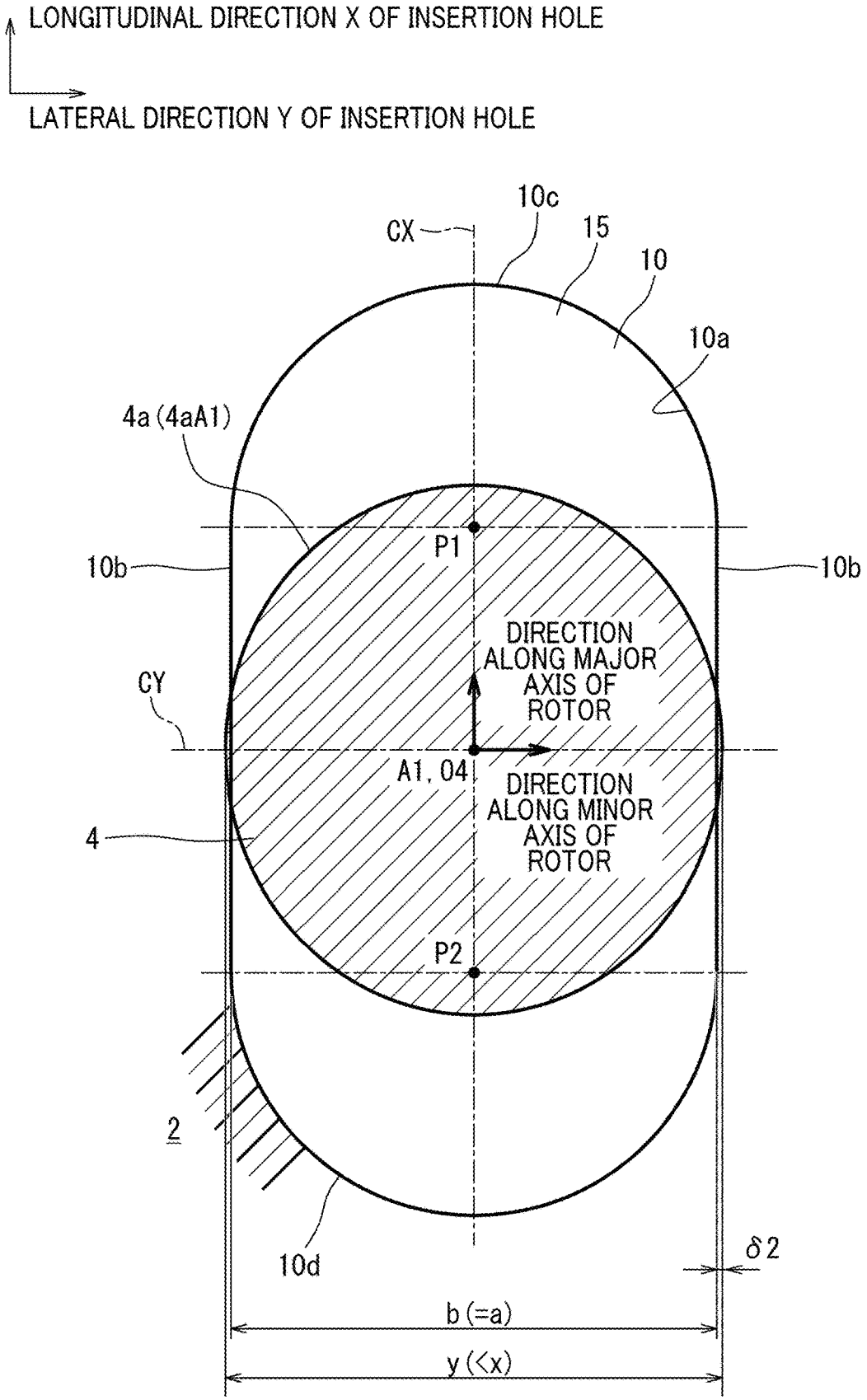
FIG. 6 is a cross-sectional view of the rotor located in the middle area of the insertion hole.

Referring to FIG. 4, when the rotor 4 has the cross-sectional center O4 at the first turn position P1 or the second turn position P2, the rotor 4 has the longitudinal axis parallel to the lateral direction Y and the lateral axis parallel to the longitudinal direction X. The major diameter of the rotor 4 is the first rotor width x. Referring to FIG. 5, during displacement of the cross-sectional center O4 between the turn position P1 or P2 and the central axis A1, the rotor 4 rotates by 90 degrees with its width decreasing gradually from the first rotor width x. Referring to FIG. 6, when the rotor 4 has the cross-sectional center O4 at the central axis A1, the rotor 4 has the longitudinal axis parallel to the longitudinal direction X and the lateral axis parallel to the lateral direction Y. The minor diameter of the rotor 4 is the second rotor width y.

In this manner, the first hole width a is equal to the second hole width b, and the first rotor width x is greater than the second rotor width y. The first interference amount δ1 is thus larger than the second interference amount δ2. The second rotor width y (the minor diameter of the rotor 4) is greater than the interval (the second hole width b) between the pair of straight portions 10*b*. Thus, during displacement of the cross-sectional center O4 from the turn position P1 or P2 toward the central axis A1 in the longitudinal direction X, the interference amount δ in the lateral direction Y decreases gradually from the first interference amount δ1 to the second interference amount δ2.

For a rotor 4 with the shape of a perfect circle in the cross section, the first rotor width is equal to the second rotor width and the first interference amount is equal to the second interference amount (with the first hole width a and the second hole width b equal to each other in the present embodiment). When this comparative rotor with the perfect circle shape has a diameter equal to the major diameter of the rotor 4 in the present embodiment, the first interference amount δ1 in the present embodiment is substantially the same as with the comparative rotor and the second interference amount δ2 is smaller than with the comparative rotor. The structure in the present embodiment thus achieves substantially the same sealing tightness in the two end areas of the insertion hole 10 as with the comparative rotor, and uses a less driving force for rotating the rotor 4 in the middle area of the insertion hole 10 than with the comparative rotor. When the comparative rotor with the perfect circle shape has a diameter equal to the minor diameter of the rotor 4 in the present embodiment, the first interference amount δ1 in the present embodiment is larger than with the comparative rotor, and the second interference amount δ2 is substantially the same as with the comparative rotor. The structure in the present embodiment thus achieves substantially as easy rotation in the middle area of the insertion hole 10 as with the comparative rotor, and also achieves tighter sealing in two end areas of the insertion hole 10 than with the comparative rotor.

As described above, the uniaxial eccentric screw pump 100 according to the present embodiment achieves tight sealing and also reduces the driving force for rotating the rotor 4.

When the cross-sectional center O4 is at the first turn position P1 as shown in FIG. 3 or 4, the outer peripheral surface 4*a* of the rotor 4 has the distal end in the longitudinal-axis direction in contact with the first semicircular portion 10*c* of the insertion hole 10. The interference amount between the rotor 4 and the first semicircular portion 10*c* is largest, or the first interference amount δ1, at the connection position at which the first semicircular portion 10*c* is connected to each straight portion 10*b*, and is smallest at the peak at which the first semicircular portion 10*c* intersects with the center line CX. In the present embodiment, the first turn position P1 corresponds to the connection position at which the first semicircular portion 10*c* is connected to each straight portion 10*b* in the longitudinal direction. An interference amount δX of the rotor 4 at the peak in the longitudinal direction X is thus equal to the second interference amount δ2. The same applies to when the cross-sectional center O4 is at the second turn position P2. When the comparative rotor with the perfect circle shape has a diameter equal to the minor diameter of the rotor 4 in the present embodiment, the interference amount δX in the longitudinal direction X is substantially the same as with the comparative rotor and the first interference amount δ1 in the lateral direction Y is larger than with the comparative rotor, achieving tighter sealing.

Figure 7:
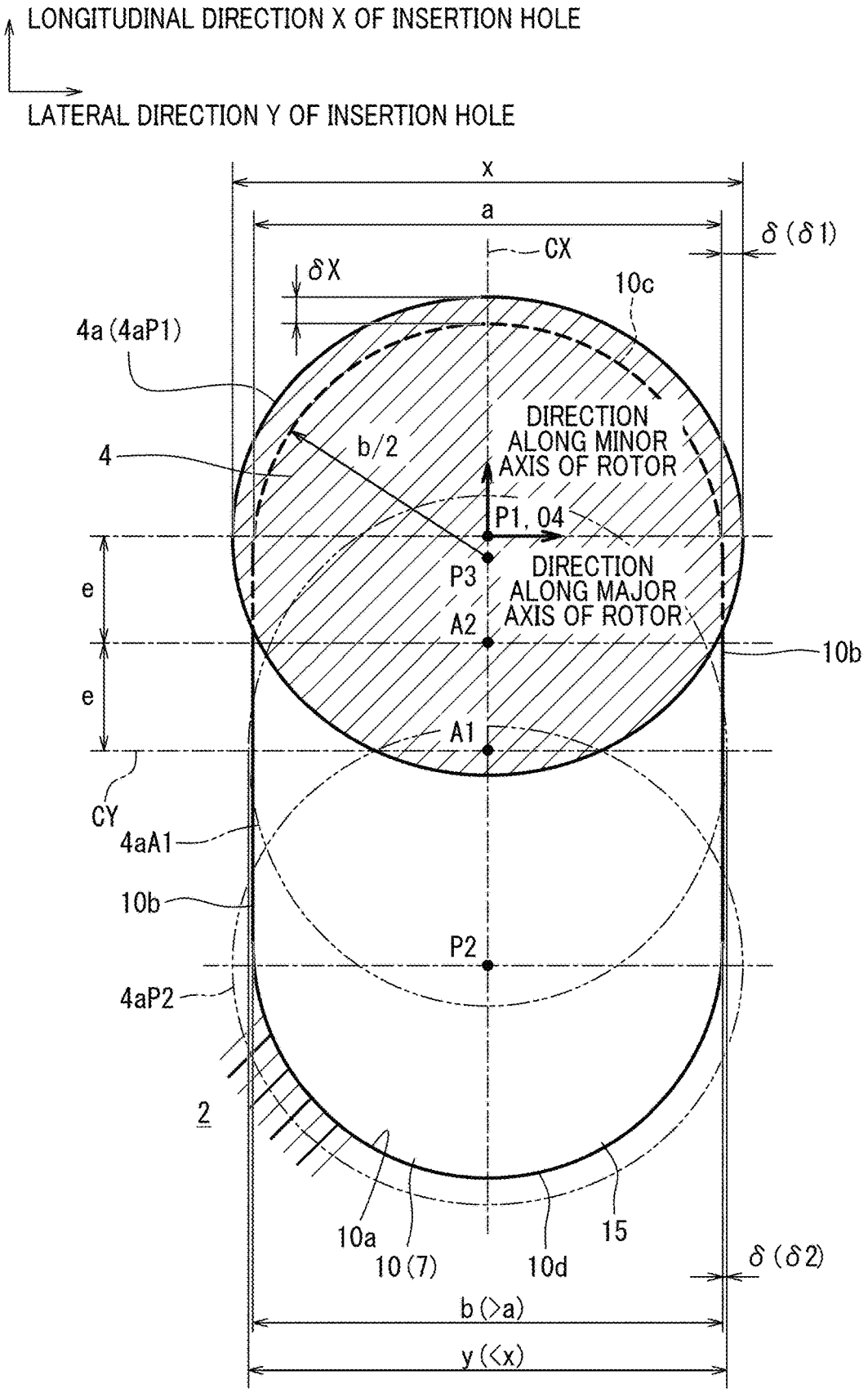
FIG. 7 is a cross-sectional view of a stator and a rotor in a modification of the first embodiment.

FIG. 7 shows a modification of the first embodiment. In the modification, the first turn position P1 is closer to the distal end of the insertion hole 10 than a connection position P3 at which the first semicircular portion 10*c* is connected to each straight portion 10*b* in the longitudinal direction X. This also applies to the positional relationship between the second turn position P2, each straight portion 10*b*, and the second semicircular portion 10*d*. This causes the first hole width a to be less than the second hole width b, thus increasing the difference of the first interference amount δ1 from the second interference amount δ2. When the cross-sectional center O4 is at the first turn position P1, the rotor 4 has the lateral axis parallel to the longitudinal direction X and has the outer peripheral surface 4*a* in contact with the peak of the first semicircular portion 10*c* in the longitudinal direction X. With the first turn position P1 closer to the distal end, the interference amount δX in the longitudinal direction X is sufficiently large to maintain highly tight sealing, although the lateral axis is parallel to the longitudinal direction X. When the imaginary rotor with a perfect circle shape has a diameter substantially equal to the major diameter of the rotor 4 in the present embodiment, when the rotor 4 in the present embodiment has the difference between the major diameter and the minor diameter substantially equal to the distance between the first turn position P1 and the connection position P3, and when the imaginary rotor with the perfect circle shape has the turn positions aligned with the connection positions, the interference amount δX in the longitudinal direction X with the rotor 4 in the present embodiment is substantially the same as the interference amount in the longitudinal direction X with the imaginary rotor with the perfect circle shape.

Figure 8:
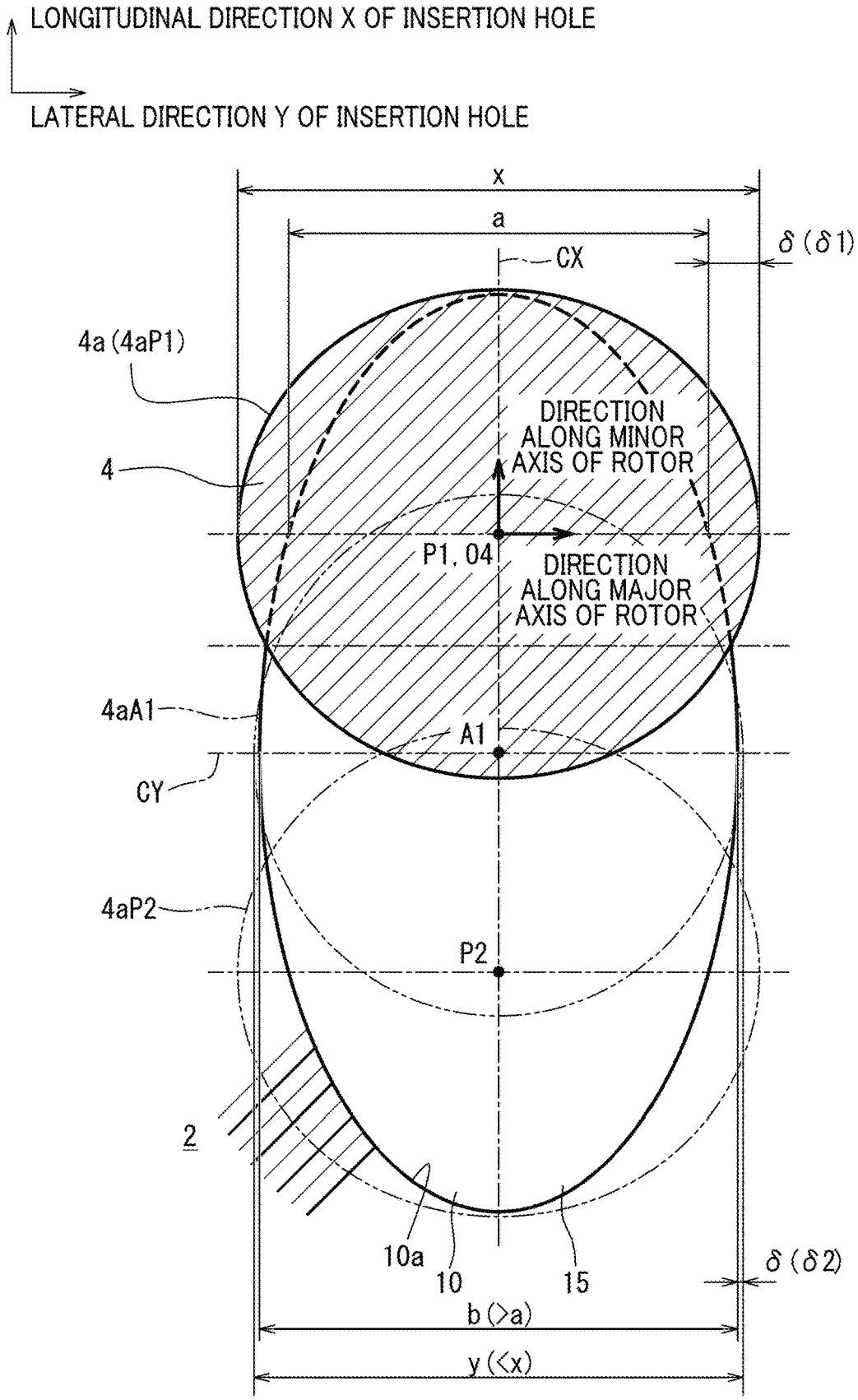
FIG. 8 is a cross-sectional view of a stator and a rotor in a second embodiment.

FIG. 8 is a cross-sectional view of a stator 2 and a rotor 4 in a second embodiment. In the present embodiment, the first hole width a is less than the second hole width b (a<b). The rotor 4 has the same shape as in the first embodiment, with the first rotor width x greater than the second rotor width y. The first interference amount δ1 is thus larger than the second interference amount δ2. The first hole width a less than the second hole width b can easily create a larger difference of the first interference amount δ1 from the second interference amount δ2.

The insertion hole 10 has a shape of, for example, an ellipse. The second hole width b corresponds to the minor diameter of the ellipse. The first hole width a has a less value than the second hole width b (minor diameter).

Figure 9:
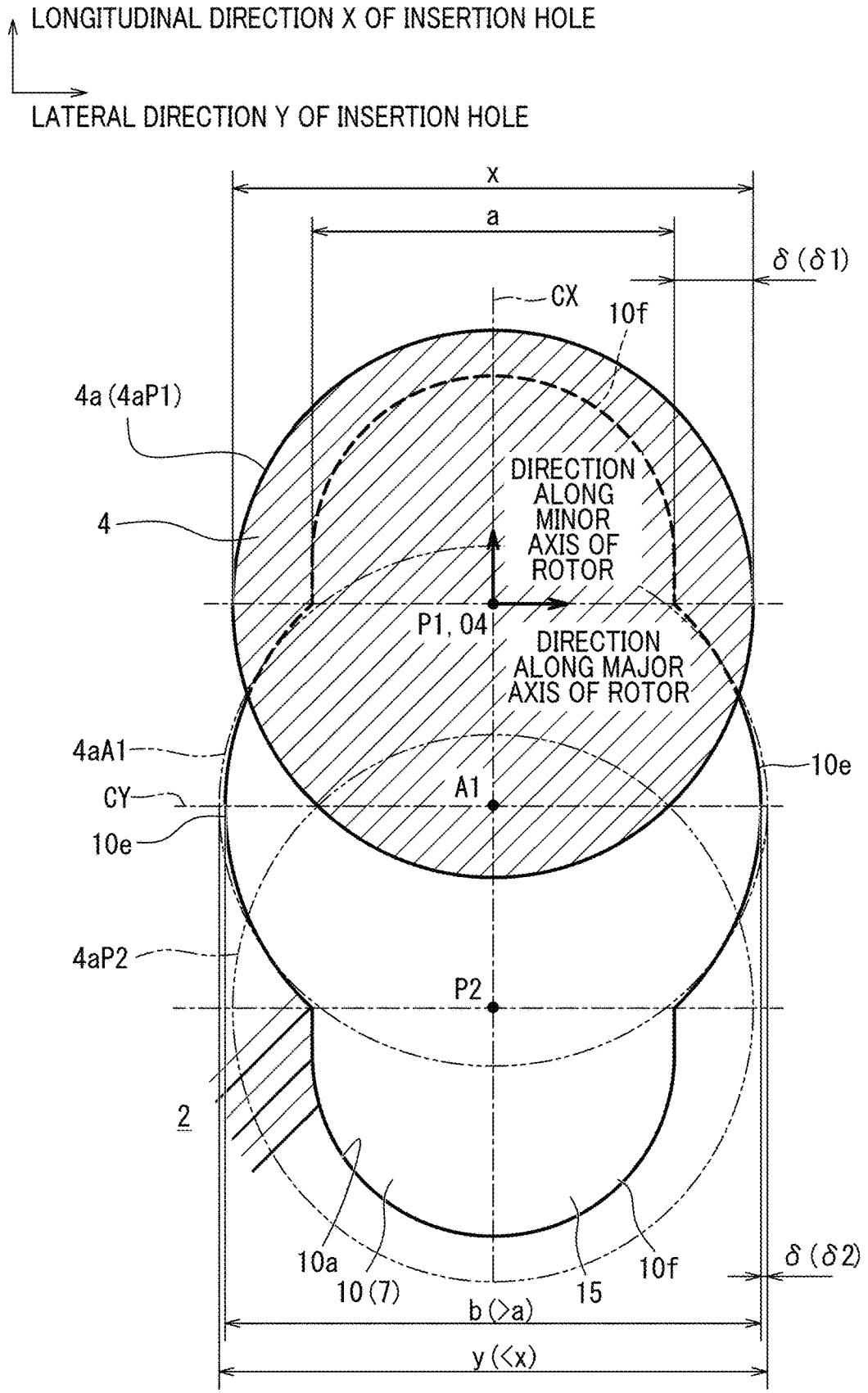
FIG. 9 is a cross-sectional view of a stator and a rotor in a modification of the second embodiment.

The insertion hole 10 having the first hole width a less than the second hole width b may have any shape other than an ellipse. For example, as shown in FIG. 9, the insertion hole 10 may have a shape combining multiple circular arcs with different curvature radii. In this modification, the insertion hole 10 has a shape including a pair of circular arc portions 10*e* protruding away from the central axis A1 in the lateral direction Y, in place of the pair of straight portions 10*b* of the racetrack. The pair of circular arc portions 10*e* are symmetric about the center line CX. Each circular arc portion 10*e* has line symmetry about the center line CY. The shape includes semicircular portions 10*f* connecting the corresponding ends of the pair of circular arc portions 10*e*, similarly to the semicircular portions 10*c* and 10*d* (refer to FIG. 3) in the first embodiment. This shape easily creates a greater difference between the first hole width a and the second hole width b. The circular arc portions 10*e* may either be circular arcs of a perfect circle or elliptical arcs. The circular arc portions 10*e* may be modified to curves other than circular arcs (e.g., parabolic curves).

Figure 10:
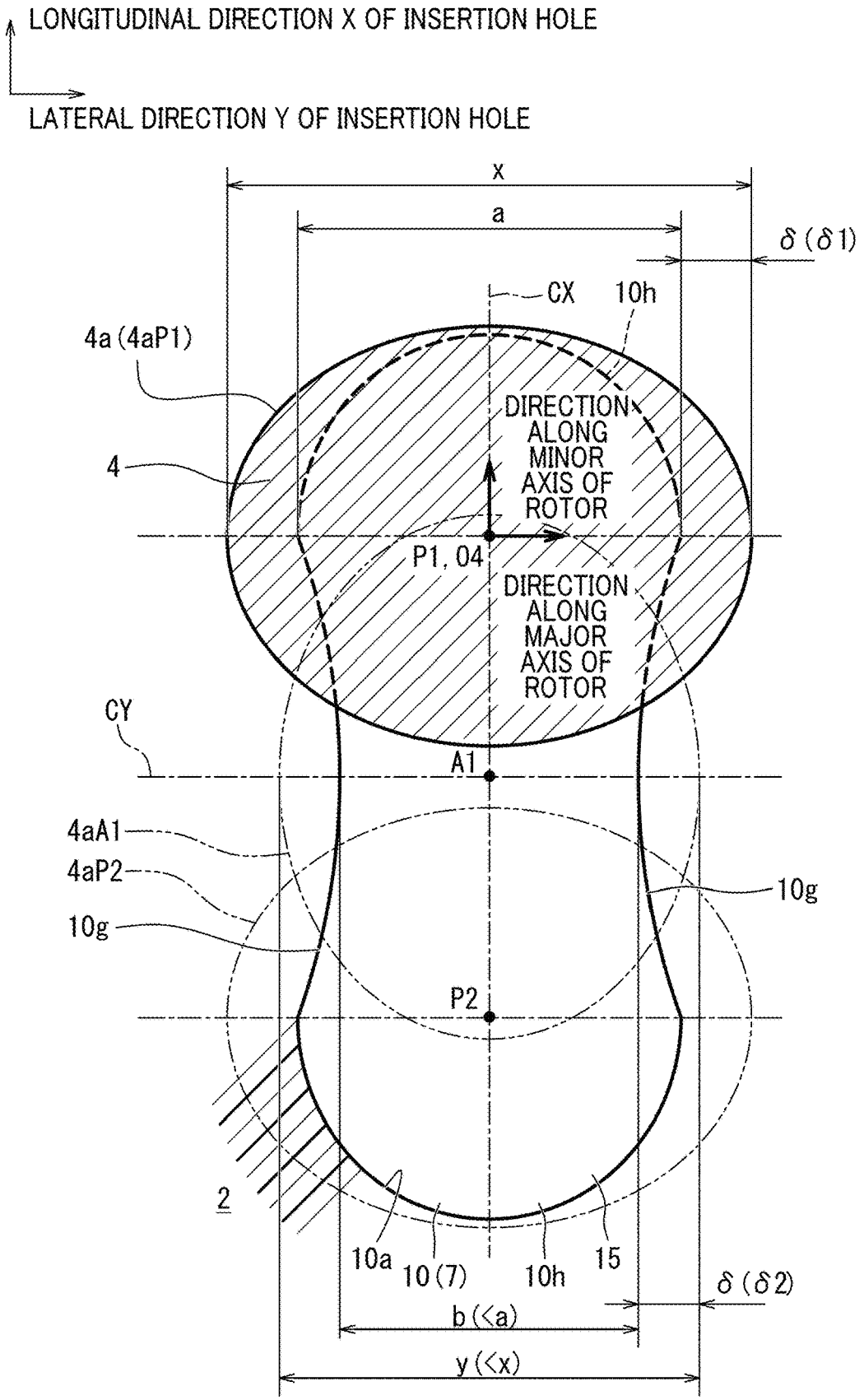
FIG. 10 is a cross-sectional view of a stator and a rotor in a third embodiment.

FIG. 10 is a cross-sectional view of a stator 2 and a rotor 4 in a third embodiment. In the present embodiment, the first hole width a is greater than the second hole width b (a>b). To cause the first interference amount δ1 to be larger than the second interference amount δ2, the first rotor width x is greater than the second rotor width y, and the difference of the first rotor width x from the second rotor width y is greater than the difference of the first hole width a from the second hole width b (x−y>a−b>0). The rotor 4 has the shape of a non-perfect circle, such as an ellipse, having the longitudinal axis and the lateral axis perpendicular to each other at the cross-sectional center O4, as in the first embodiment.

For example, the insertion hole 10 may have a shape combining multiple circular arcs with different curvature radii. The insertion hole 10 has a shape including a pair of circular arc portions 10*g* curved inward toward the central axis A1 in the lateral direction, in place of a pair of straight portions of the racetrack. The pair of circular arc portions 10*g* are symmetric about the center line CX. Each circular arc portion 10*g* has line symmetry about the center line CY. The shape includes semicircular portions 10*h* connecting the corresponding ends of the pair of circular arc portions 10*g*, similarly to the semicircular portions 10*c* and 10*d* (refer to FIG. 3) in the first embodiment. This shape easily allows the first hole width a to be greater than the second hole width b. The circular arc portions 10*g* may either be circular arcs of a perfect circle or elliptical arcs. The circular arc portions 10*g* may be modified to curves other than circular arcs (e.g., hyperbolic curves).

Although the rotor 4 is elliptical in the cross section in the above embodiments, the rotor 4 may have another shape. More specifically, the rotor 4 may simply have the shape of a non-perfect circle having the major axis and the minor axis in the cross section. In this case, the rotor 4 may have line symmetry about the major axis and the minor axis in the cross section.

Figure 11:
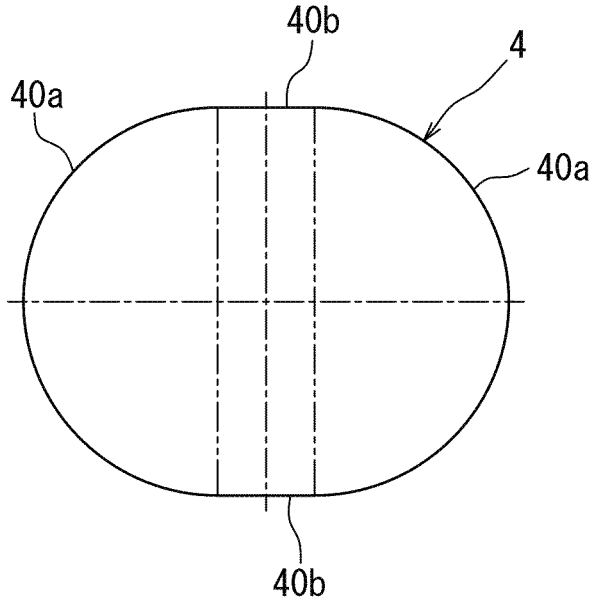
FIG. 11 is a cross-sectional view of a rotor in another example of the present embodiment.
Figure 12:
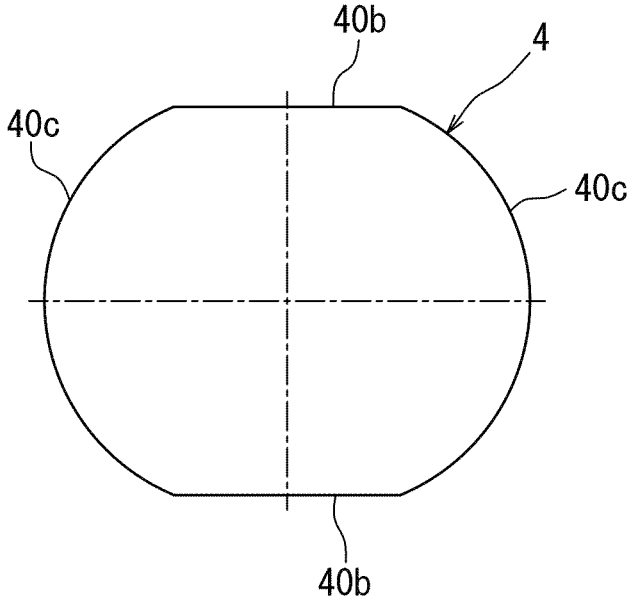
FIG. 12 is a cross-sectional view of a rotor in another example of the present embodiment.
Figure 13:
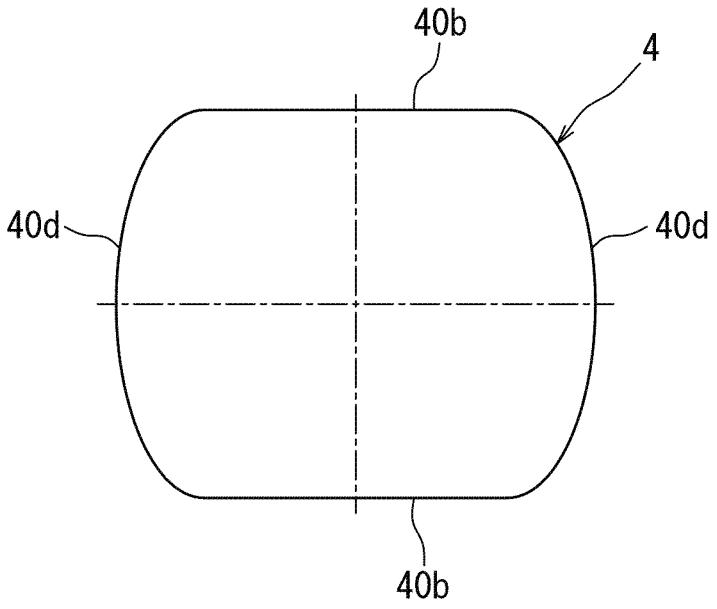
FIG. 13 is a cross-sectional view of a rotor in another example of the present embodiment.

For example, as shown in FIG. 11, the rotor 4 may have, in the cross section, an oval shape including semicircles 40*a* defining the two ends of the oval in the longitudinal-axis direction, with the semicircles 40*a* connected with straight lines 40*b*. The oval shape may include an oval-like shape. For example, each semicircle may include multiple straight lines. In this case, the straight lines may be connected with smooth curves such as circular arcs. The oval-like shape may include any lines. For example, the shape may have the two ends in the longitudinal-axis direction defined by circular arcs 40*c* that are shorter than semicircles as shown in FIG. 12, or defined by parts 40*d* of an ellipse as shown in FIG. 13 (the two sides spaced from each other in the horizontal direction and extending along the vertical axis in the figure).

When the rotor 4 with the oval cross-sectional shape is located in one of the two end areas of the insertion hole 10, the rotor 4 has its semicircular portion in contact with the straight line defining the end area with a predetermined interference amount. During movement of the rotor 4 from the end area toward the middle area, the rotor 4 rotates with its longitudinal axis gradually rotating to align with the longitudinal direction X of the insertion hole 10. This gradually reduces the tightness of contact between the outer peripheral surface 4*a* of the rotor 4 and the inner peripheral surface 10*a* of the insertion hole 10 in the stator 2. When the rotor 4 is at the central axis A1, the rotor 4 has the longitudinal axis parallel to the longitudinal direction X and is least susceptible to the force from the stator 2.

Figure 14:
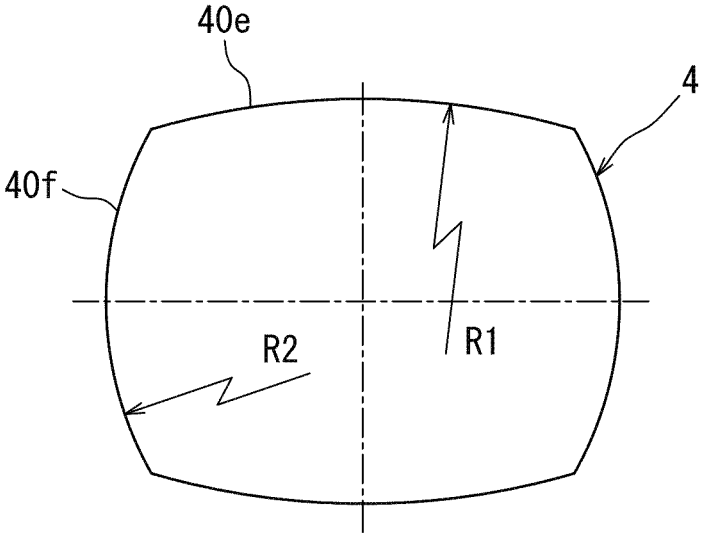
FIG. 14 is a cross-sectional view of a rotor in another example of the present embodiment.
Figure 15:
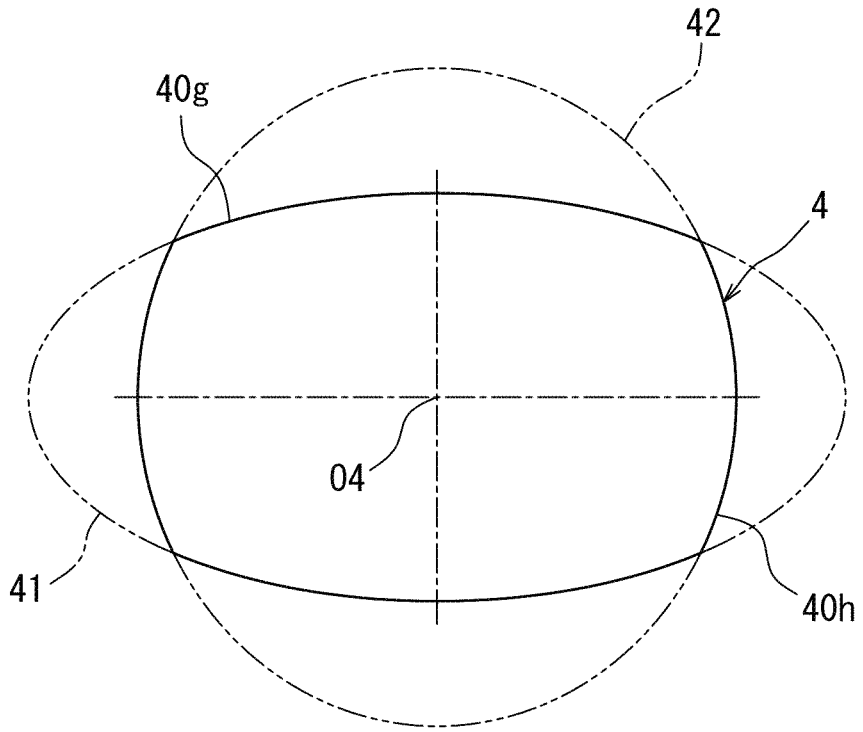
FIG. 15 is a cross-sectional view of a rotor in another example of the present embodiment.

The rotor 4 may have a shape combining multiple circular arcs with different curvature radii in the cross section. For example, as shown in FIG. 14, the shape may include circular arcs 40*e* at the two sides spaced from each other in the lateral-axis direction and extending along the longitudinal axis and circular arcs 40*f* at the two sides spaced from each other in the longitudinal-axis direction and extending along the lateral axis. The circular arcs 40*e* may have a first curvature radius R1, and the circular arcs 40*f* may have a second curvature radius R2 smaller than the first curvature radius R1. As shown in FIG. 15, the shape may include first curves 40*g* at the two sides spaced from each other in the lateral-axis direction and extending along the longitudinal axis and second curves 40*h* at the two sides spaced from each other in the longitudinal-axis direction and extending along the lateral axis. The first curves 40*g* (the two ends along the lateral axis) may be parts of a first ellipse. The second curves 40*h* (the two ends along the longitudinal axis) may be parts of a second ellipse and have a curvature radius different from the curvature radius of the first curves 40*g*. In the example in FIG. 15, the first curves 40*g* are two parts of a single first ellipse 41, and the second curves 40*h* are two parts of a single second ellipse 42, with the centers of the first ellipse 41 and the second ellipse 42 aligned with each other. However, this is not limitative. The first curves 40*g* may simply be symmetric about the longitudinal axis, and the second curves 40*h* may simply be symmetric about the lateral axis. For example, the center of the first ellipse 41 defining the first curves 40*g* may be offset from the center O4 in opposite directions (upward and downward in FIG. 15), or in other words, in the positive direction and the negative direction along the lateral axis, by the same distance. The same applies to the second curves 40*h*. The shape may combine an ellipse and circular arcs. More specifically, the two sides in the lateral-axis direction may be parts of an ellipse, and the two sides in the longitudinal-axis direction may be circular arcs.

Figure 16:
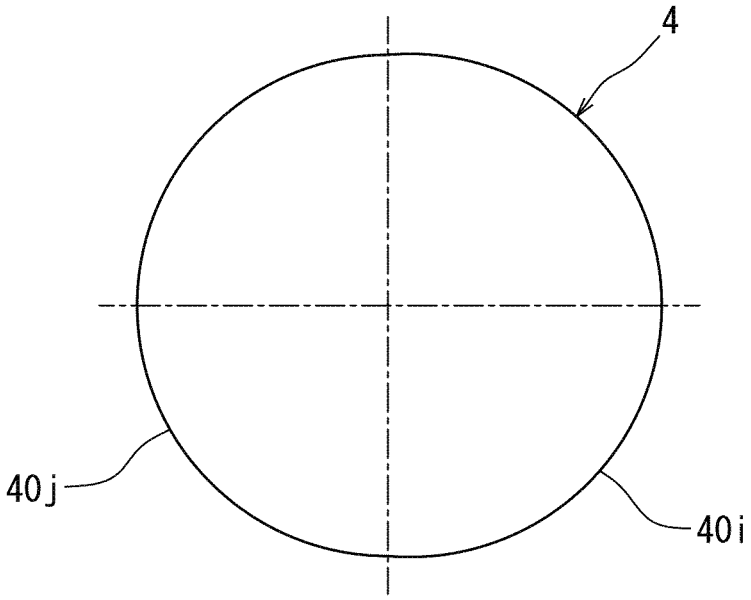
FIG. 16 is a cross-sectional view of a rotor in another example of the present embodiment.

The rotor 4 may be asymmetric in the horizontal (longitudinal) direction about the vertical (lateral) axis in the cross section. For example, as shown in FIG. 16, the rotor 4 may have a shape including a semi-elliptical portion 40*i*, which is half of an ellipse, on the right of the vertical axis and a semicircular portion 40*j* on the left of the vertical axis in the cross section. The minor axis of the ellipse is aligned with the vertical axis. In this structure, the rotor 4 comes in contact with the inner peripheral surface 10*a* of the insertion hole 10 in the stator 2 differently between its left and right portions in the cross section during rotation of the rotor 4, thus increasing the design flexibility as appropriate for the use.

As described above, the rotor 4 may be used in any of the structures in the first to third embodiments when the rotor 4 has the longitudinal axis and the lateral axis in the cross section and satisfies $\delta 1 > \delta 2$. In the second embodiment, the rotor 4 may have the shape of a perfect circle in the cross section.

In the above embodiments, the casing 1 receives a fluid through the first opening 5 and discharges the fluid through the second opening 6. In some embodiments, the casing 1 may receive a fluid through the second opening 6 and discharge the fluid through the first opening 5 by rotating the rotor 4 in the reverse direction.

Figure 17:
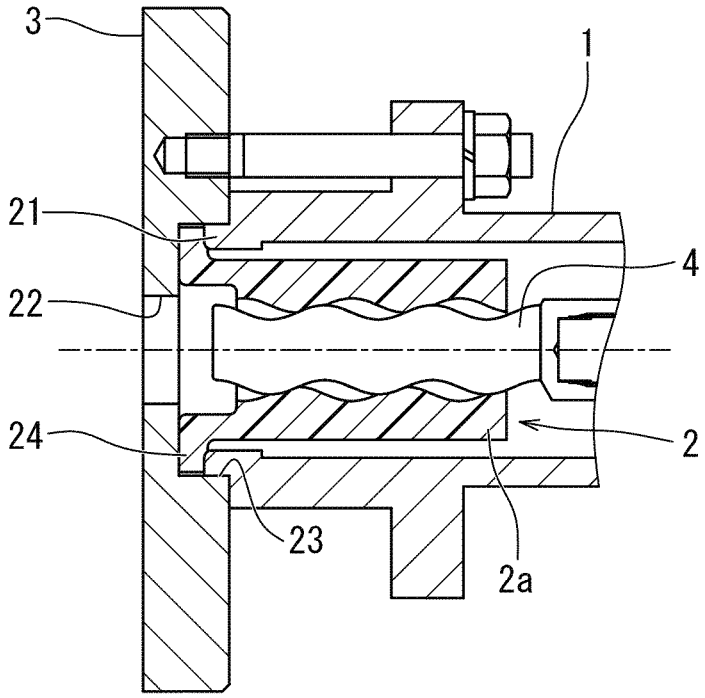
FIG. 17 is a partial longitudinal sectional view of a uniaxial eccentric screw pump according to another embodiment.

In the above embodiments, the stator 2 includes the outer cylinder 2*b* and the stator body 2*a*. In some embodiments, the stator 2 may include the stator body 2*a* without an outer cylinder as shown in FIG. 17. The casing 1 is stepped at the first end and includes a radially-inward end portion 21 that is cylindrical and protruding from the first end. The end stud 3 has a central hole 22 in one surface and a recess 23 surrounding the central hole 22. The stator body 2*a* includes a flange 24 at the first end. The recess 23 on the end stud 3 receives the flange 24 on the stator body 2*a* and also receives the radially-inward end portion 21 of the casing 1. The end stud 3 can thus fix the stator 2 (stator body 2*a*) with the flange 24 tightly held between the bottom surface of the recess 23 and the end face of the radially-inward end portion 21.

In this structure, the stator 2 (stator body 2*a*) is deformable radially outward and cantilevered with the tightly held portion. This simple structure facilitates manufacture at low costs. Unlike in the above embodiments, this structure eliminates an adhesive to fix the outer cylinder 2*b* and the stator body 2*a* to each other, thus eliminating concerns about, for example, the resistance of the adhesive to the fluid.

The invention claimed is:

1. A uniaxial eccentric screw pump, comprising:

a stator having an insertion hole with an inner peripheral surface being internally threaded; and a rotor including a shaft being externally threaded and placed through the insertion hole in the stator, the rotor being configured to perform eccentric rotation about a central axis of the stator, wherein in a cross section perpendicular to the central axis, the insertion hole is an elongated hole, the rotor has a cross-sectional center displaceable in a reciprocating manner in a longitudinal direction of the insertion hole between a pair of turn positions along a center line extending in the longitudinal direction through the central axis of the stator during the eccentric rotation of the rotor, and the pair of turn positions are opposite to each other in the longitudinal direction with respect to the central axis, the rotor comes in contact with the inner peripheral surface of the insertion hole in a lateral direction of the insertion hole perpendicular to the longitudinal direction, an interference amount between the rotor and the stator includes a first interference amount when the cross-sectional center is at one of the pair of turn positions and a second interference amount when the cross-sectional center is at the central axis, and the first interference amount is larger than the second interference amount, the insertion hole has a first hole width being a dimension of the insertion hole in the lateral direction at each of the pair of turn positions in a natural state with no contact with the rotor, and has a second hole width being a dimension of the insertion hole in the lateral direction at the central axis in the natural state, the rotor has a first rotor width being a dimension of the rotor in the lateral direction at the cross-sectional center at each of the pair of turn positions, and has a second rotor width being a dimension of the rotor in the lateral direction at the cross-sectional center at the central axis, and a difference of the first rotor width from the second rotor width is greater than a difference of the first hole width from the second hole width.

2. The uniaxial eccentric screw pump according to claim 1, wherein the interference amount between the rotor and the stator decreases gradually from the first interference amount to the second interference amount with the cross-sectional center being displaced from one of the pair of turn positions toward the central axis along the center line.

3. The uniaxial eccentric screw pump according to claim 1, wherein when the cross-sectional center is at a point on the center line, the interference amount between the rotor and the stator is an excess of a distance between the cross-sectional center at the point and an outer peripheral surface of the rotor in the lateral direction over a distance between the point and the inner peripheral surface of the insertion hole in the lateral direction in the natural state.

4. The uniaxial eccentric screw pump according to claim 1, wherein the first hole width is less than the second hole width.

5. The uniaxial eccentric screw pump according to claim 1, wherein the first hole width is equal to the second hole width.

6. The uniaxial eccentric screw pump according to claim 5, wherein the insertion hole has a shape of a racetrack in the cross section.

7. The uniaxial eccentric screw pump according to claim 1, wherein the first hole width is greater than the second hole width.

8. The uniaxial eccentric screw pump according to claim 1, wherein the stator consists of a stator body formed from an elastic material.

9. The uniaxial eccentric screw pump according to claim 1, wherein when the cross-sectional center is at one of the pair of turn positions, the rotor has an outer peripheral surface in contact with the inner peripheral surface of the insertion hole in the longitudinal direction with a predetermined interference amount in the longitudinal direction.

10. A uniaxial eccentric screw pump, comprising:

a stator having an insertion hole with an inner peripheral surface being internally threaded; and a rotor including a shaft being externally threaded and placed through the insertion hole in the stator, the rotor being configured to perform eccentric rotation about a central axis of the stator, wherein in a cross section perpendicular to the central axis, the insertion hole is an elongated hole, the rotor has a cross-sectional center displaceable in a reciprocating manner in a longitudinal direction of the insertion hole between a pair of turn positions along a center line extending in the longitudinal direction through the central axis of the stator during the eccentric rotation of the rotor, and the pair of turn positions are opposite to each other in the longitudinal direction with respect to the central axis, the rotor comes in contact with the inner peripheral surface of the insertion hole in a lateral direction of the insertion hole perpendicular to the longitudinal direction, an interference amount between the rotor and the stator includes a first interference amount when the cross-sectional center is at one of the pair of turn positions and a second interference amount when the cross-sectional center is at the central axis, and the first interference amount is larger than the second interference amount, the rotor has a shape of a non-perfect circle having a longitudinal axis and a lateral axis perpendicular to each other in the cross section, when the cross-sectional center is at one of the pair of turn positions, the longitudinal axis is parallel to the lateral direction and the lateral axis is parallel to the longitudinal direction, and when the cross-sectional center is at the central axis, the longitudinal axis is parallel to the longitudinal direction and the lateral axis is parallel to the lateral direction.

11. The uniaxial eccentric screw pump according to claim 10, wherein the rotor is elliptical in the cross section.

12. The uniaxial eccentric screw pump according to claim 10, wherein the rotor is oval in the cross section.

13. The uniaxial eccentric screw pump according to claim 10, wherein the rotor includes, in the cross section, first curves at two sides in a direction in which the lateral axis extends, and includes second curves at two ends in a direction in which the longitudinal axis extends, and the first curves have a greater curvature radius than the second curves.

14. The uniaxial eccentric screw pump according to claim 10, wherein the rotor is, in the cross section, asymmetric in a direction in which the longitudinal axis extends.

* * * * *